US011564498B1

(12) United States Patent
Li et al.

(10) Patent No.: US 11,564,498 B1
(45) Date of Patent: Jan. 31, 2023

(54) INTELLIGENT SOFA MECHANICAL EXTENSION DEVICE

(71) Applicant: DewertOkin Technology Group Co., Ltd., Zhejiang (CN)

(72) Inventors: Long Li, Zhejiang (CN); Bin Shen, Zhejiang (CN); Pengfei He, Zhejiang (CN); Liming Yang, Zhejiang (CN)

(73) Assignee: DewertOkin Technology Group Co., Ltd., Jiaxing (CN)

( * ) Notice: Subject to any disclaimer, the term of this patent is extended or adjusted under 35 U.S.C. 154(b) by 0 days.

(21) Appl. No.: 17/461,965

(22) Filed: Aug. 30, 2021

(51) Int. Cl.

| | |
|---|---|
| ***A47C 7/14*** | (2006.01) |
| ***A47C 7/28*** | (2006.01) |
| ***A47C 1/024*** | (2006.01) |
| ***A47C 1/0355*** | (2013.01) |
| ***A47C 17/04*** | (2006.01) |

(52) U.S. Cl.
CPC ..... *A47C 1/0355* (2013.01); *A47C 17/04* (2013.01)

(58) Field of Classification Search
CPC ... A47C 1/0355; A47C 1/0352; A47C 1/0345; A47C 17/04; A47C 17/045
See application file for complete search history.

(56) References Cited

U.S. PATENT DOCUMENTS

| | | | | |
|---|---|---|---|---|
| 5,098,158 | A * | 3/1992 | Palarski | A47C 7/506 297/312 |
| 10,349,745 | B2 * | 7/2019 | Huang | A47C 1/0355 |
| 11,140,990 | B2 * | 10/2021 | Sun | A47C 1/024 |
| 11,377,007 | B2 * | 7/2022 | Samain | B60N 2/853 |
| 2010/0102605 | A1 * | 4/2010 | Yamada | B60N 2/2222 297/284.3 |
| 2015/0289655 | A1 * | 10/2015 | Lawson | A47C 1/0342 297/75 |
| 2016/0273632 | A1 * | 9/2016 | Lawson | F16H 25/20 |
| 2017/0042330 | A1 * | 2/2017 | Bruce | A47C 17/04 |
| 2017/0258230 | A1 * | 9/2017 | Huang | A47C 1/0355 |
| 2019/0350368 | A1 * | 11/2019 | Lapointe | A47C 1/0355 |
| 2020/0282865 | A1 * | 9/2020 | Samain | B60N 2/02 |
| 2021/0219725 | A1 * | 7/2021 | Sun | A47C 1/03211 |
| 2022/0039558 | A1 * | 2/2022 | Zhang | A47C 1/0355 |
| 2022/0071396 | A1 * | 3/2022 | Zhang | A47C 7/5068 |
| 2022/0125200 | A1 * | 4/2022 | Zhang | A47C 1/032 |

* cited by examiner

*Primary Examiner* — Shin H Kim

(57) ABSTRACT

The present application provides an intelligent sofa mechanical extension device, including a base, a driving component and an extension component, where the driving component and the extension component are disposed on the base. The driving component includes a motor and a motor guide rail that are disposed on the base. The motor guide rail is provided with a motor moving slider in a slidable manner. An end of the motor is connected to the moving slider. The moving slider is connected to a driving rod through a drive connector. The driving rod is disposed on the seat cushion support assemblies on the left and the right side. The extension component is driven to stretch or retract with back-and-forth movement of the motor moving slider along the motor guide rail.

8 Claims, 7 Drawing Sheets

INTELLIGENT SOFA MECHANICAL EXTENSION DEVICE

The contents of Chinese Patent Application No. 202020656342.X filed on Apr. 26, 2020 and published on Dec. 1, 2020, is a grace period disclosure and shall not be prior art to claimed invention.

TECHNICAL FIELD

The present application belongs to the technical field of furniture and relates to a sofa seat device and, in particular, to an intelligent sofa mechanical extension device.

BACKGROUND

With the improvement of social productivity and the development of economic level, people's demand for a better life is growing day by day, and the demand for furniture is also getting higher and higher. At present, many recliners, sofas, and the like are equipped with mechanical extension devices, in which backrests, seat cushions, and leg rest plates are installed. An electromechanical extension device is usually a combination of various mechanical connectors and is pushed to stretch or retract by drive assemblies. The mechanical connectors are operable to provide various comfortable performances. However, the existing electromechanical extension devices are complicated in structure, bulky and very cumbersome, resulting in waste of space as well as inconvenience of transportation and installation. Moreover, due to the combination of the connectors, during the electric driving process of the movable sofa, the mechanical extension device will shake apparently and wobble and deform easily when the device is opened in the swing process. The functional and structural stability of the sofa will be affected and a function of zero-gravity lying posture of the human body is not able to be achieved.

SUMMARY

The present application provides an intelligent sofa mechanical extension device that has a simple structure, a definite position of the mechanical extension device in a sitting posture, lying posture and TV posture, a clear sequence of extension and retracting, a more stable state of the mechanical extension device in various postures, so as to reduce wobbling and deformation, a more sufficient extension of limiting connectors of backrest assemblies, so as to make the lying posture flatter and have a function of zero-gravity lying posture of the human body.

The present application provides an intelligent sofa mechanical extension device, including a base, a driving component and an extension component, where the driving component and the extension component are disposed on the base. The extension component includes the backrest assemblies disposed in pairs and disposed on a left side and a right side of the base, seat cushion support assemblies disposed in pairs and disposed on the left side and the right side of the base, and the leg rest plate assemblies disposed in pairs and disposed on the left side and the right side of the base. A front end of a seat cushion support assembly and a rear end of the seat cushion support assembly are hinged to an end of the backrest assembly and an end of the leg rest assembly respectively. The driving component includes a motor and a motor guide rail that are disposed on the base. The motor guide rail is provided with a motor moving slider in a slideable manner. An end of the motor is connected to the moving slider. The moving slider is connected to a driving rod through a driving connector. The driving rod is disposed on the seat cushion support assemblies on the left side and the right side. Moreover, the extension component is driven to stretch or retract with back-and-forth movement of the motor moving slider along the motor guide rail.

In the above-described intelligent sofa mechanical extension device, the seat cushion supporting assembly includes a support connector a. The support connector a is integrally formed with a lying posture limiter for limiting movement of the extension component.

In the above-described intelligent sofa mechanical extension device, the support connector a is provided with two seat frame mounting components. In a lying posture, an angle between the base and a connecting line of bent portions of the two seat frame mounting components is greater than or equal to 13° and less than or equal to 23°. In the above-described intelligent sofa mechanical extension device, the seat cushion support assembly further includes a support connector b, a support connector c and a support connector d. An end of the support connector c is hinged to a middle position of the support connector d. The driving rod is fixed to an end of the support connector b after penetrating through the support connector a. Another end of the support connector b is hinged to another end of the support connector c. The support connector a is provided with an extending portion that inclines upwards and is hinged to the backrest assembly. A first connector is hinged to the support connector a. The first connector is provided with a sitting posture limiting pin for limiting movement. The lying posture limiter is used for limiting movement of a lower end face of the first connector. Another end of the first connector is hinged to a second connector and another end of the second connector is hinged to the base. The first connector is hinged to a third connector. Another end of the third connector is hinged to the backrest assembly. A fourth connector is hinged to an inner side of the support connector d. A fifth connector is hinged to the second connector. A sixth connector is hinged between an end of the fourth connector and an end of the fifth connector. The support connector a is hinged to a middle position of the sixth connector.

In the above-described intelligent sofa mechanical extension device, the seat cushion support assembly includes the support connector a. The support connector a is provided with the extending portion that inclines upwards. The one backrest assembly includes a backrest connector a, a backrest connector b, a backrest connector c and a backrest connector d. An end of a lower portion of the backrest connector a is hinged to an end of the backrest connector b. Another end of the lower portion of the backrest connector a is hinged to the extending portion of the support connector a. An end of a lower portion of the backrest connector c is hinged to another end of the backrest connector b. Another end of the lower portion of the backrest connector c is hinged to an end of the third connector. An upper portion of the backrest connector c is hinged to an end of the backrest connector d. Another end of the backrest connector d is hinged to the base.

In the above-described intelligent sofa mechanical extension device, a backrest spring is disposed between the backrest connector c and the extending portion of the support connector a.

In the above-described intelligent sofa mechanical extension device, a hinge point between the upper portion of the backrest connector c and the backrest connector d is always located below a middle position of the extending portion of the support connector a during the extension component extension or retracting.

In the above-described intelligent sofa mechanical extension device, the one leg rest plate assembly includes a leg rest plate connector a, a leg rest plate connector b, and a leg rest plate connector c. An end of the leg rest plate connector a is hinged to an end of the support connector d. an end of the leg rest plate connector b is hinged to an end of the support connector a. Another end of the leg rest plate connector b is hinged to an end of the leg rest plate connector c. Another end of the leg rest plate connector a is hinged to a leg rest plate frame. Another end of the leg rest plate connector c is hinged to the leg rest plate frame. The leg rest plate connector a and the leg rest plate connector c are fixed with each other after being disposed in parallel. The leg rest plate connector a is hinged to the leg rest plate connector b. The leg rest plate connector b is provided with a limiting protrusion for limiting movement of an upper end face of the leg rest plate connector b.

In the above-described intelligent sofa mechanical extension device, a first fixing rod is disposed between second connectors on the left side and the right side of the base.

In the above-described intelligent sofa mechanical extension device, a second fixing rod is disposed between backrest connectors c on the left side and the right side of the base. A third fixing rod is disposed between backrest connectors d on the left side and the right side of the base.

Compared with the prior art, the present application has outstanding and beneficial technical effects as follows: the present application is provided with a backset spring in the extension component, which makes a leg portion stretch first and then a backrest rotate when the extension component is extension. In the retraction state, the backset spring enables the backset to rotate first and then the leg portion to retract. At the same time, the backset spring enables the extension component to have a definite and stable position in the sitting posture, lying posture and TV posture, has the clear sequence of extension and retracting. The limit in the lying posture and the limit in the TV posture adopt a V-shaped limiting protrusion that is integrally formed with the support connector a. The limit in the sitting posture adopts two kinds of limit modes of the limiting pin and a V-shaped limiting protrusion that is integrally formed with the support connector a, so that the mechanical extension device is more stable in each posture state and is less susceptible to wobbling and deformation. In addition, the hinge point between the upper portion of the backrest connector c and the backrest connector d is always located below the middle of the extending portion of the support connector a during the extension or retraction of the extension component, so that the hinge point position between the backrest connector c and the backrest connector d is lower, that is, an expanded distance between the backrest connector c and the backrest connector d is shorter. The support connector a is provided with the two seat frame mounting components. In the lying posture, the angle between the base and the connecting line of the bent portions of the two seat frame mounting components is greater than or equal to 13° and less than or equal to 23°, which accords with the ergonomic structure, so that the lying posture is flatter, and a function of zero-gravity lying posture of the human body is able to realize, that is more comfortable.

DETAILED DESCRIPTION

Figure 1:
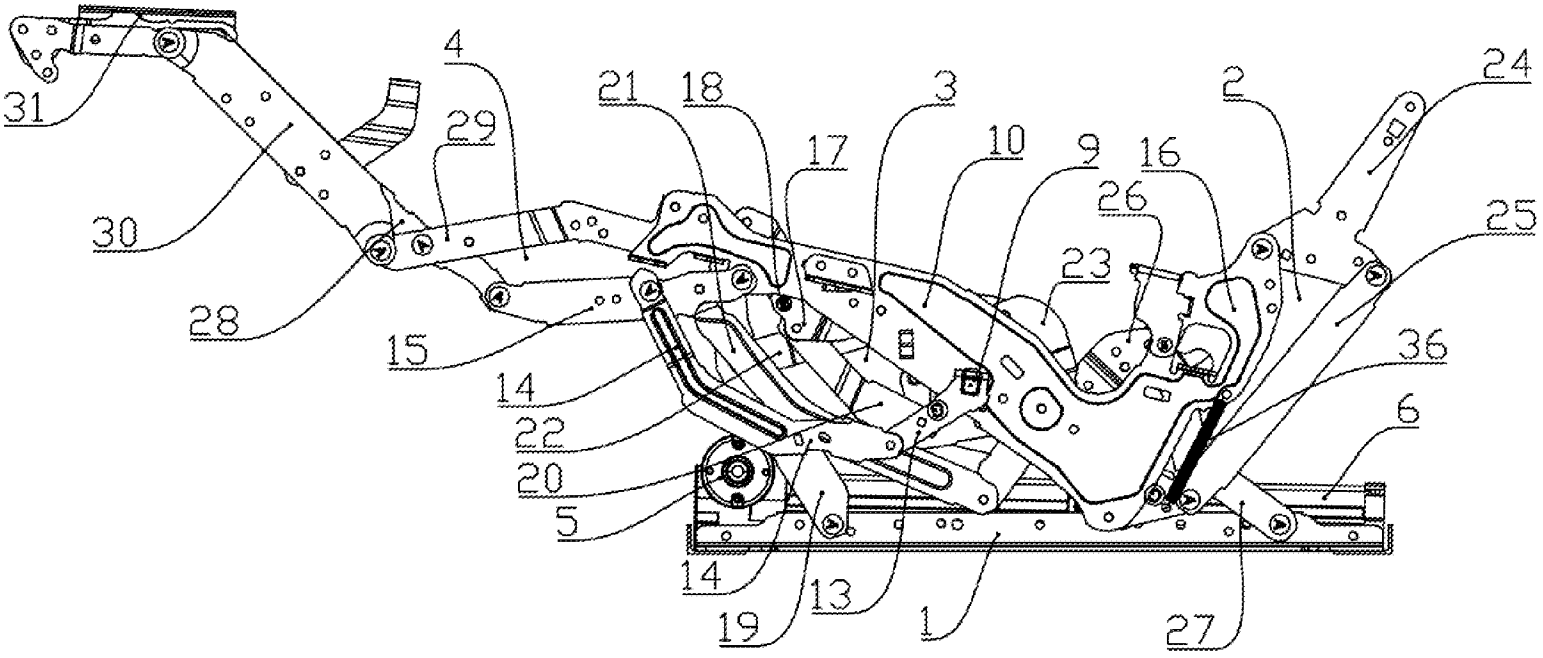
FIG. 1 is a schematic structure diagram of an extension component in a TV posture according to the present application.
Figure 2:
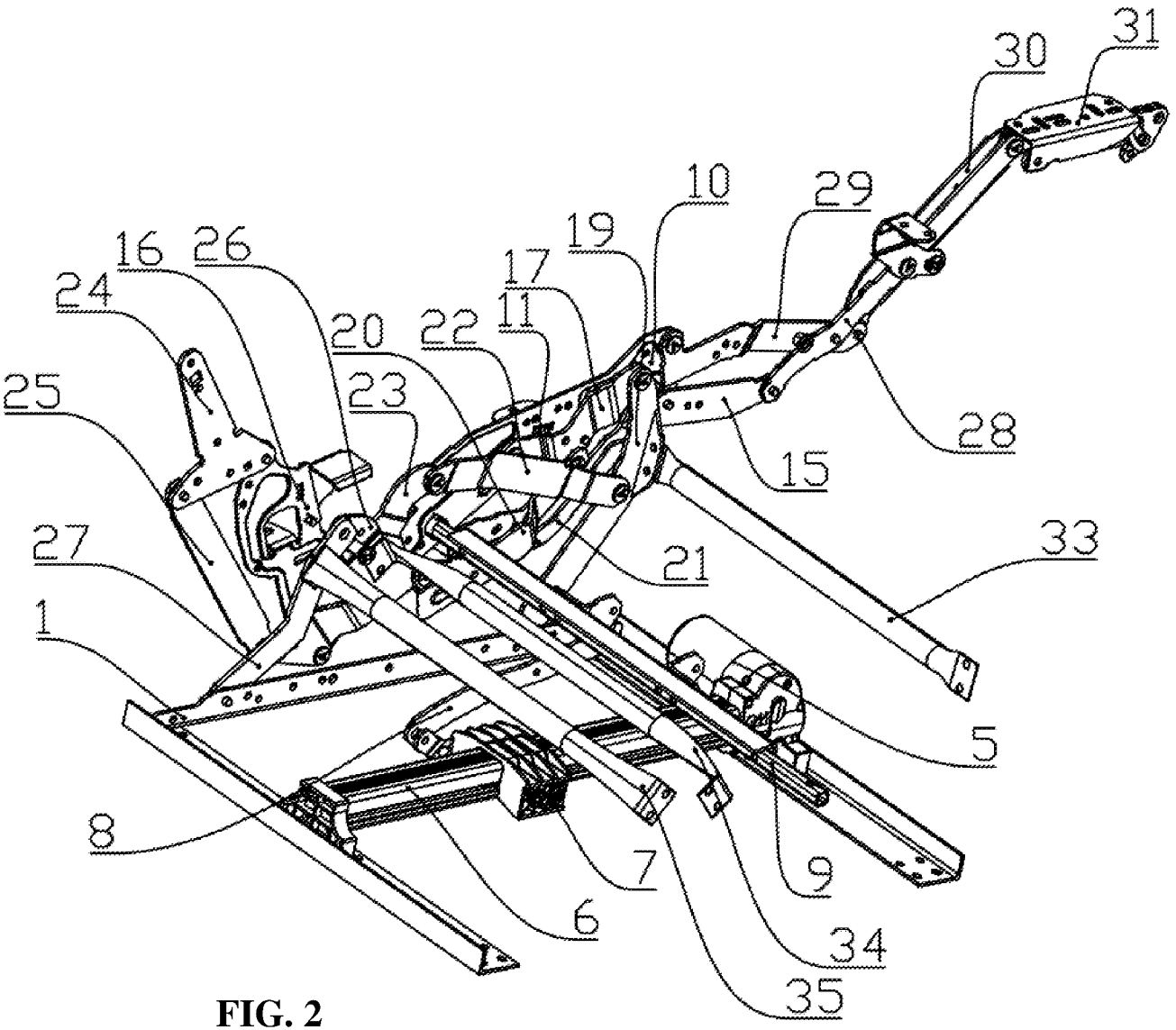
FIG. 2 is a schematic structure diagram of the extension component in the TV posture according to the present application.
Figure 3:
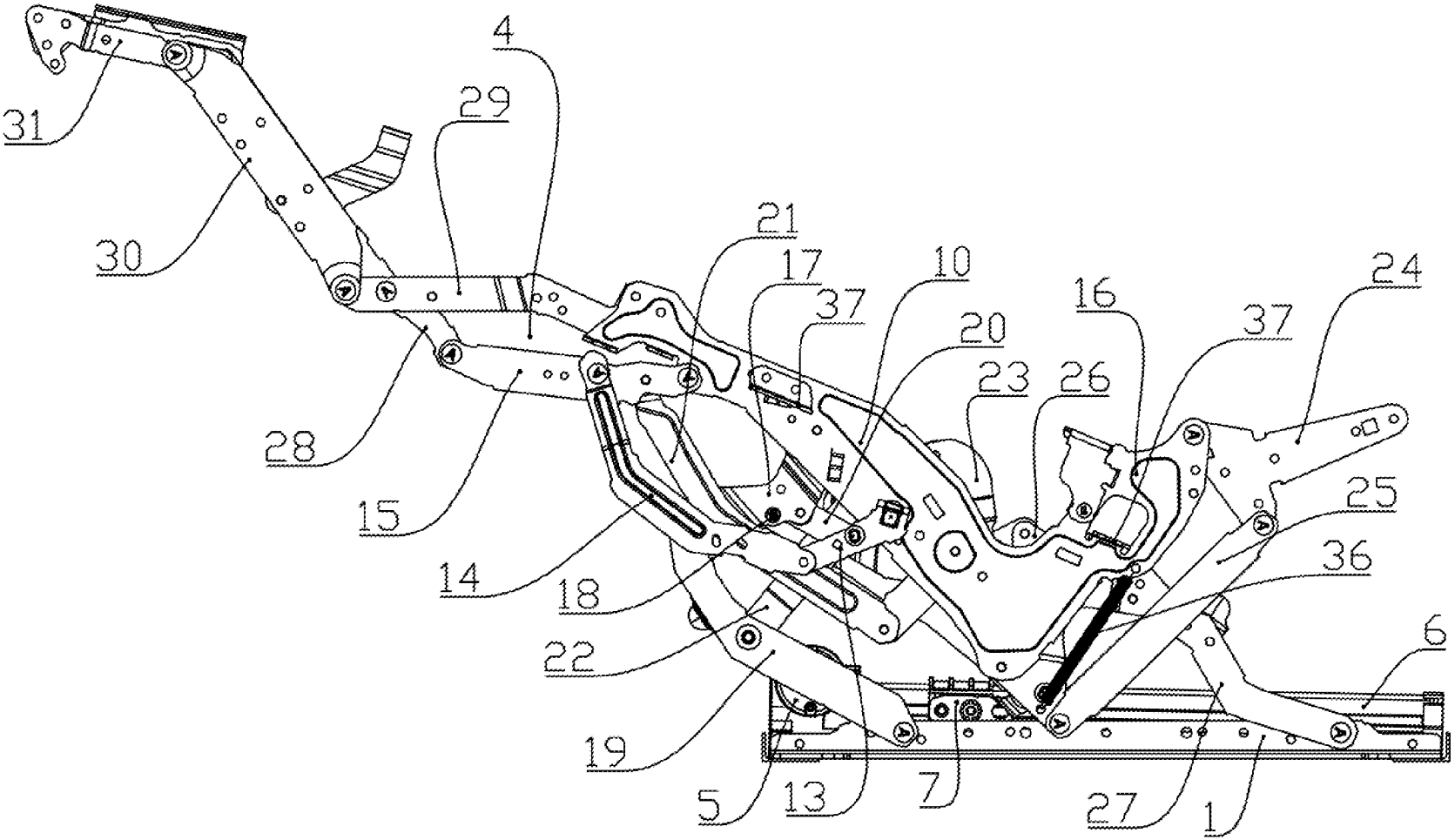
FIG. 3 is a schematic structure diagram of the extension component in a lying posture according to the present application.
Figure 4:
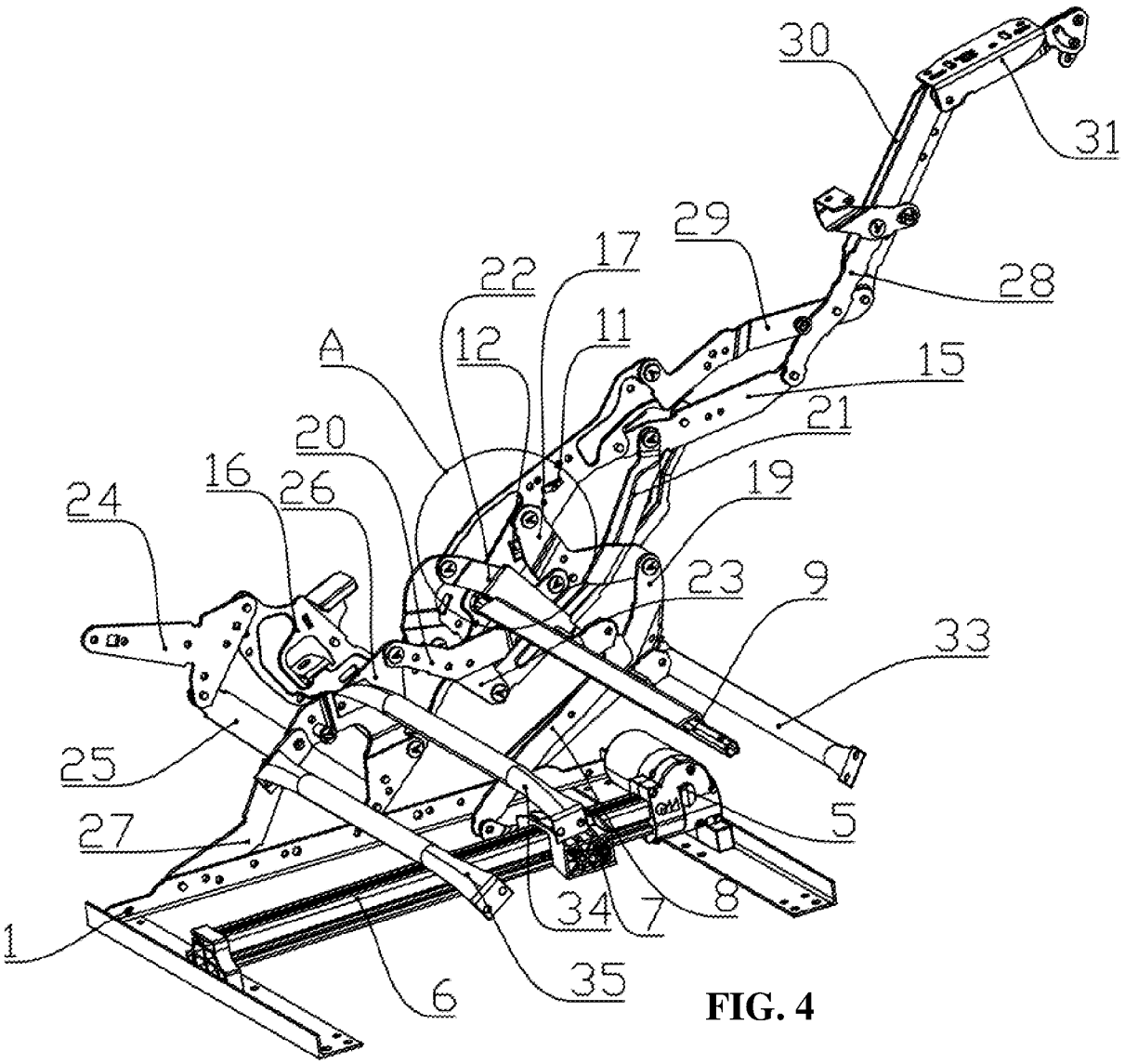
FIG. 4 is a schematic structure diagram of the extension component in the lying posture according to the present application.
Figure 5:
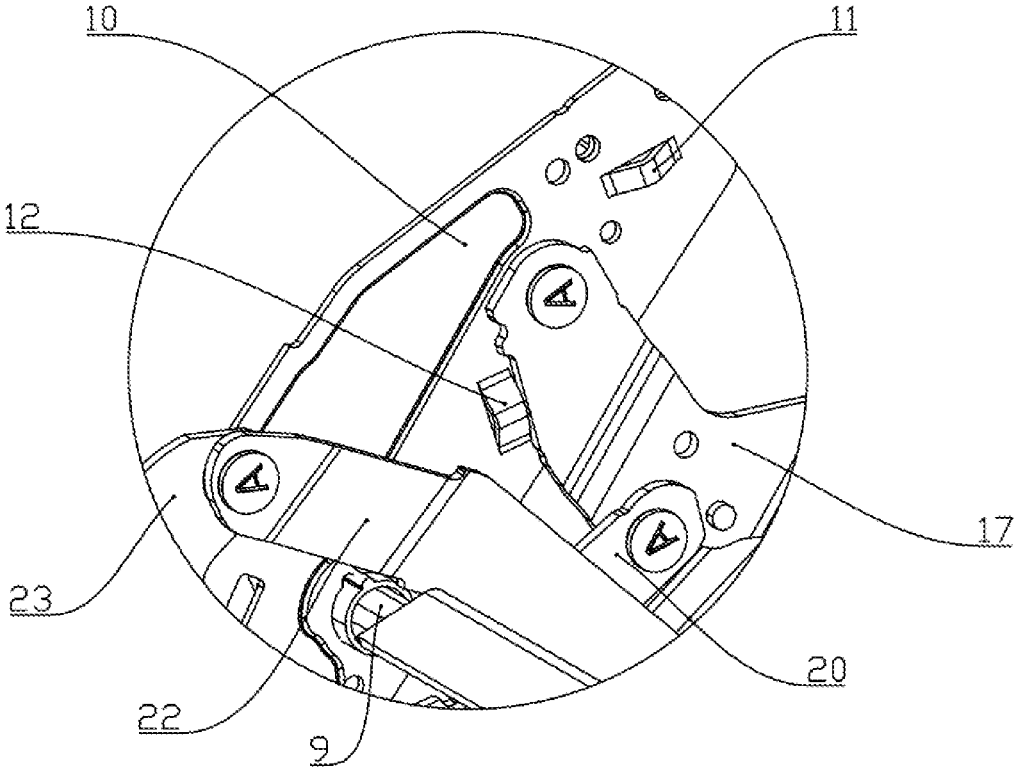
FIG. 5 is a partial enlarged diagram of the portion "A" in FIG. 4 of the present application.
Figure 6:
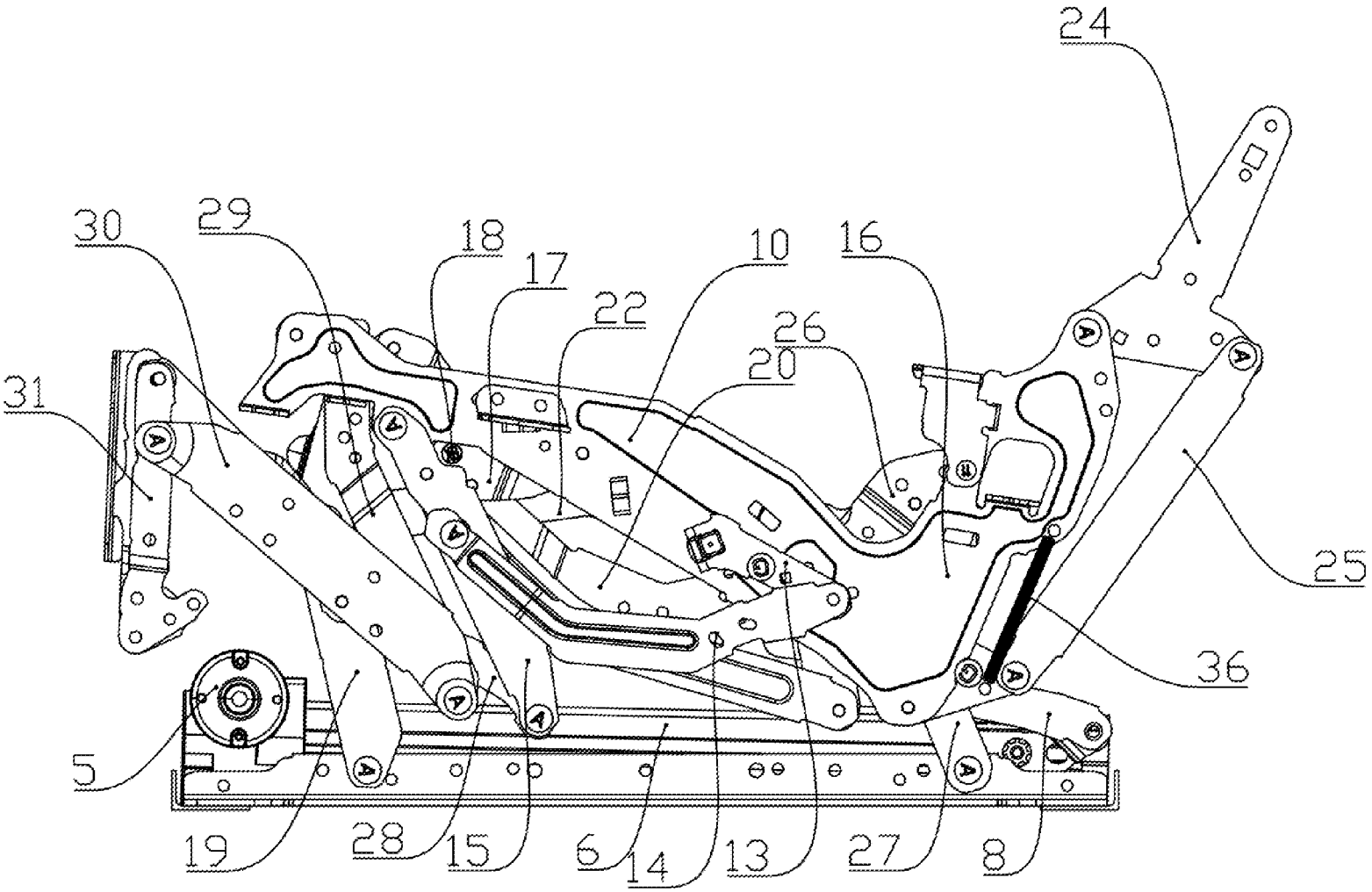
FIG. 6 is a schematic structure diagram of the extension component in a sitting posture according to the present application.
Figure 7:
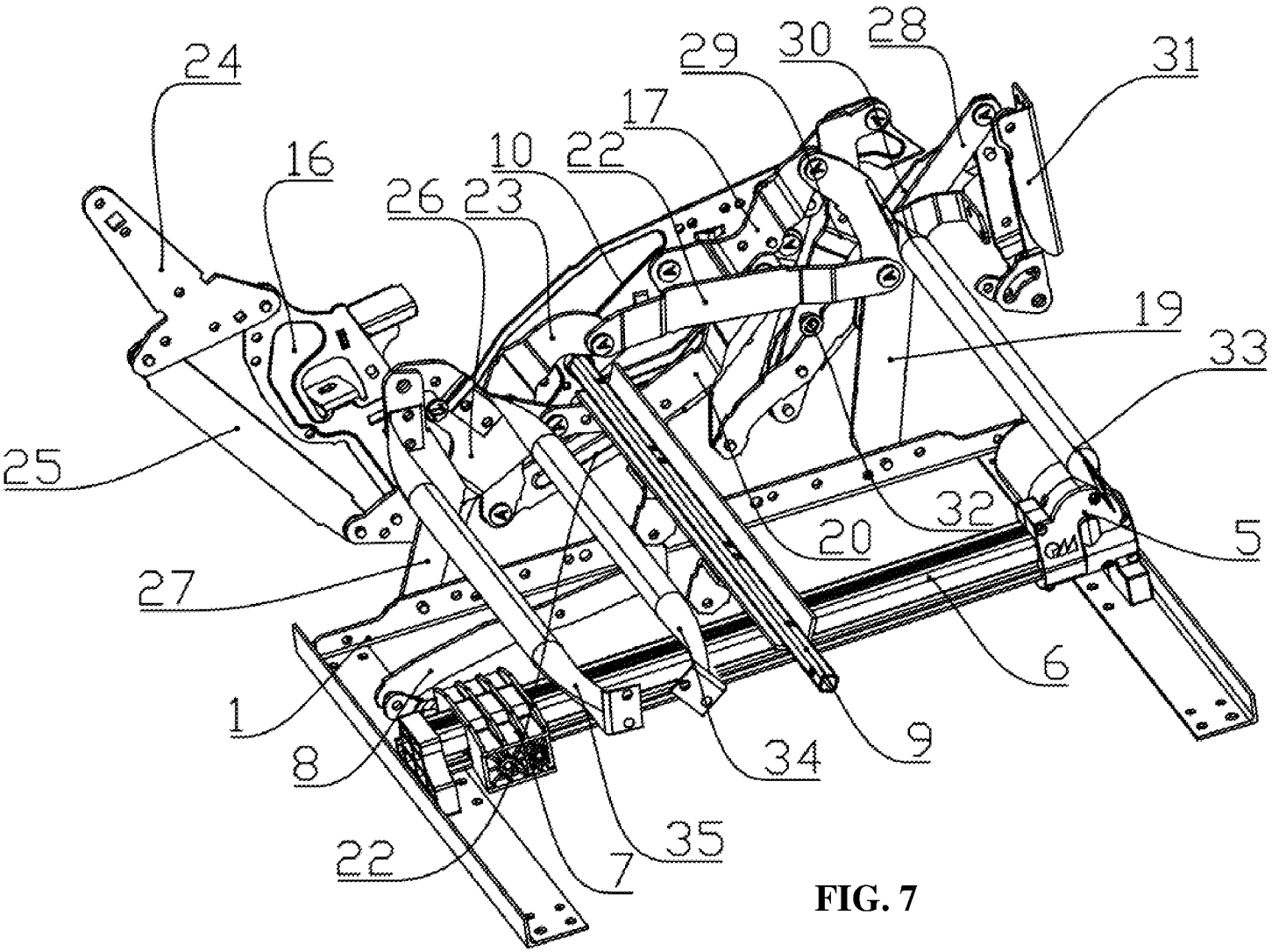
FIG. 7 is a schematic structure diagram of the extension component in the sitting posture according to the present application.

Hereinafter the present application will be further described in conjunction with specific embodiments:

Referring to FIGS. 1 to 7, an intelligent sofa mechanical extension device includes a base 1, a driving component and an extension component that are disposed on the base 1. The extension component includes backrest assemblies 2, seat cushion support assemblies 3, and leg rest plate assemblies 4, which are disposed on the left side and the right side of the base 1 in pairs. A front end and a rear end of one seat cushion support assembly 3 are respectively hinged to an end of one backrest assembly 2 and an end of one leg rest assembly 4. A seat cushion supporting assembly 3 includes a support connector a10. The support connector a10 is integrally formed with a lying posture limiter 12 with a V-shape, which is used for limiting movement of the extension component. The lying posture limiter 12 is. The seat cushion support assembly 3 further includes a support connector b13, a support connector c14 and a support connector d15. An end of the support connector c14 is hinged to the middle position of the support connector d15. A driving rod 9 penetrates through the support connector a10 and is fixed to an end of the support connector b13. Another end of the support connector b13 is hinged to another end of the support connector c14. The support connector a10 is provided with an extending portion 16 that inclines upwards and is hinged to the backrest assembly 2. The support connector a10 is hinged with a first connector 17 that is provided with a sitting posture limiting pin 18 for limiting movement of the first connector 17. The lying posture limiter 12 is used for limiting movement of a lower end face of the first connector 17. Another end of the first connector 17 is hinged to a second connector 19. Another end of the second connector 19 is hinged to the base 1. The first connector 17 is hinged to a third connector 20. Another end of the third connector 20 is hinged to the backrest assembly 2. A fourth connector 21 is hinged to the inner side of the support connector d15. A fifth connector 22 is hinged to the second connector 19. A sixth connector 23 is hinged between an end of the fourth connector 21 and an end of the fifth connector 22. The support connector a10 is hinged to the middle position of the sixth connector 23. The backrest assembly 2 includes a backrest connector a24, a backrest connector b25, a backrest connector c26, and a backrest connector d27. An end of the lower portion of the backrest connector a24 is hinged to an end of the backrest connector b25, and another end of the lower portion of the backrest connector a24 is hinged to the extending portion 16 of the support connector a10. An end of the lower portion of the backrest connector c26 is hinged to another end of the backrest connector b25, and another end of the lower portion of the backrest connector c26 is hinged to an end of the third connector 20. The upper portion of the backrest connector c26 is hinged to an end of the backrest connector d27. Another end of the backrest connector d27 is hinged to the base 1. A backrest spring is disposed between the backrest connector c26 and the extending portion 16 of the support connector a10. A hinge point, at which the upper portion of the backrest connector c26 and the backrest connector d27 are hinged, is always located below the middle position of the extending portion 16 of the support connector a10 during extending or retracting of the extension component. The leg rest plate assembly 4 includes a leg rest plate connector a28, a leg rest plate connector b29, and a leg rest plate connector c30. An end of the leg rest plate connector a28 is hinged to an end of the support connector d15. An end of the leg rest plate connector b29 is hinged to an end of the support connector a10, and another end of the leg rest plate connector b29 is hinged to an end of the leg rest plate connector c30. Another end of the leg rest plate connector a28 and another end of the leg rest plate connector c30 are respectively hinged to the leg rest plate frame 31. The leg rest plate connector a28 and the leg rest plate connector c30 are fixed with each other after being disposed in parallel. The leg rest plate connector a28 is hinged to the leg rest plate connector b29. The leg rest plate connector b29 is provided with a limiting protrusion 32 for limiting movement of the upper end face of the leg rest plate connector b29. A first fixing rod 33 is disposed between the second connectors 19 on the left side and the right side of the base 1. A second fixing rod 34 is disposed between backrest connectors c26 on the left side and the right side of the base 1. A third fixing rod 35 is disposed between backrest connectors d27 on the left side and the right side of the base 1. The driving component includes a motor 5 and a motor guide rail 6 that are disposed on the base 1. A motor moving slider 7 is disposed on the motor guide rail 6 in the slidable manner. An end of the motor 5 is connected to the motor moving slider 7. The motor moving slider 7 is connected to a driving rod 9 via a driving connector 8. The driving rod 9 is disposed on the seat cushion support assemblies 3 on the left side and the right side. The extension component is driven to stretch or retract with back-and-forth movement of the motor moving slider 7 along the motor guide rail 6.

The support connector a10, the support connector b13, the support connector c14, and the support connector d15 of the extension component constitute a four bar linkage. The support connector a10, the support connector d15, the fourth connector 21, and the sixth connector 23 constitute a four bar linkage. The first connector 17, the second connector 19, the third connector 20 and the fifth connector 22 constitute a four bar linkage. The extending portion 16 of the support connector a10, the backrest connector b25, the backrest connector c26, and the backrest connector d27 constitute a four bar linkage. The support connector a10, the support connector d15, the leg rest plate connector b29, and the leg rest plate connector a28 constitute a four bar linkage. The motor 5 drives the motor moving slider 7 to move back and forth on the motor guide rail 6. The motor moving slider 7 drives the driving rod 9 to move back and forth via the drive connectors 8. The driving rod 9 drives the support connectors a10 and the support connectors b13 on the left side and the right side to move synchronously. The support connector a10 and the support connector b13 drive the four bar linkage of the extension component to stretch or retract. During extension, the extension component changes a posture sequentially from a sitting posture to a TV posture and then to a lying posture. During retracting, the extension component changes a posture sequentially from the lying posture to the TV posture and then to the sitting posture. In the sitting posture state, the motor moving slider 7 moves to the side of the one backrest assembly 2. The sitting posture limiting pin 18 is clamped on a lower side face of the support connector a10 and an upper side face of the support connector d15. A sitting posture limiter 11 is a safety limiter, so as to limit the extension component to continuingly move to the side of the one backrest assembly 2. At this time, the motor 5 stops working, that is, a stable sitting posture state is maintained. When the extension component is required to be stretched, the motor 5 drives the motor moving slider 7 to the side of the leg rest plate assembly 4. At this time, the limiting action of the sitting posture limiting pin 18 fails. When the extension component stretches to the TV posture state, the sitting posture limiter 11 is the safety limiter, and the sitting posture limiting pin 18 is disposed on the lower side face of the support connector a10, which is able to play a certain limit action. The TV posture state is able to be maintained under the action of the driving rod 9, the first fixing rod 33, the second fixing rod 34, the third fixing rod 35, and the sitting posture limiter 11. When the motor 5 continues to drive the motor moving slider 7 to move toward the side of the leg rest plate assembly 4, the first connector 17 will move downward to break away from the limit action of the sitting posture limiter 11 until the first connector 17 contacts the position of the lying posture limiter 12. At this time, the lying posture limiter 12 is completely clamped on a lower side face of the first connector 17. The stable lying posture state is achieved. When retracting, the required parts move in reverse order. In the present application, a backset spring 36 is provided in the extension component, such that the leg portion (i.e., the leg rest plate assembly 4) stretch first and then the backrest (i.e., the backset assembly 2) rotate during the extending of the extension component. In the retraction state, the backset spring enables the backset (i.e., the backset assembly 2) to rotate first and then the leg portion (i.e., the one leg rest plate assembly 4) to retract. At the same time, the backset spring enables the extension component to have the definite and stable position in the sitting posture, lying posture and TV posture, and have a clear sequence of extension and retracting. The limiting in the lying posture and in the TV posture is achieved with a V-shaped limiting protrusion that is integrally formed with the support connector a10. The limiting in the sitting posture is achieved with a limiting pin and a V-shaped limiting protrusion that is integrally formed with the support connector a10. By means of such limiting, the mechanical extension device is more stable in each posture state and is less susceptible to wobbling and deformation. In addition, the hinge point, at which the upper portion of the backrest connector c26 and the backrest connector d27 are hinged, is always located below the middle of the extending portion 16 of the support connector a10 during the extension or retraction of the extension component, so that the hinge point position between the backrest connector c26 and the backrest connector d27 is lower, that is, the expanded distance between the backrest connector c26 and the backrest connector d27 is shorter. The support connector a10 is provided with the two seat frame mounting components 37. In the lying posture, the angle between the base and a connecting line of the bent portions of the two seat frame mounting components 37 is greater than or equal to 13° and less than or equal to 23°, which accords with an ergonomic structure, so that the lying posture is flatter. A function of zero-gravity lying posture of the human body is able to realize, that is more comfortable.

The above are merely preferred embodiments of the present application. The protection range of the present application is not limited accordingly. Therefore, any equivalent changes made according to the structure, shape, and principle of the present application shall be covered within the protection range of the present application.

LIST OF REFERENCES

1 base
2 backset assembly
3 cushion support assembly
4 leg rest plate assembly
5 motor
6 motor guide rail
7 motor moving slider
8 drive connector
9 driving rod
10 support connector a
11 sitting posture limiter
12 lying posture limiter
13 support connector b
14 support connector c
15 support connector d
16 extending portion
17 first connector
18 sitting posture limiting pin
19 second connector
20 third connector
21 fourth connector
22 fifth connector
23 sixth connector
24 backrest connector a
25 backrest connector b
26 backrest connector c
27 backrest connector d
28 leg rest plate connector a
29 leg rest plate connector b
30 leg rest plate connector c
31 leg rest plate frame
32 limiting protrusion
33 first fixing rod
34 second fixing rod
35 third fixing rod
36 backrest spring
37 seat frame mounting component

What is claimed is:

1. An intelligent sofa mechanical extension device, comprising: a base (1), and a driving component and an extension component that are disposed on the base (1);

wherein the extension component comprises: backrest assemblies (2) that are disposed in pairs on a left side of the base (1) and a right side of the base (1), seat cushion support assemblies (3) that are disposed in pairs on the left side and the right side of the base (1), and leg rest plate assemblies (4) that are disposed in pairs on the left side and the right side of the base (1), wherein a front end of a seat cushion support assembly (3) and a rear end of the seat cushion support assembly (3) are hinged to an end of the backrest assembly (2) and an end of the leg rest assembly (4) respectively;

wherein the driving component comprises a motor (5) and a motor guide rail (6) that are disposed on the base (1), the motor guide rail (6) is provided with a motor moving slider (7) in a slidable manner, an end of the motor (5) is connected to the motor moving slider, the moving slider is connected to a driving rod (9) via a drive connector (8), the driving rod (9) is disposed on the seat cushion support assemblies (3) on the left side and the right side, and the extension component is driven to stretch or retract with back-and-forth movement of the motor moving slider (7) along the motor guide rail (6);

wherein the seat cushion support assembly (3) comprise a support connector a (10), and the support connector a (10) is integrally formed with a lying posture limiter (12) for limiting movement of the extension component; and wherein the support connector a (10) is provided with two seat frame mounting components (37), and in a lying posture, an angle between the base (1) and a connecting line of bent portions of the two seat frame mounting components (37) is greater than or equal to 130 and less than or equal to 230.

2. The intelligent sofa mechanical extension device of claim 1, wherein the seat cushion support assembly (3) further comprises a support connector b (13), a support connector c (14) and a support connector d (15), an end of the support connector c (14) is hinged to a middle position of the support connector d (15), the driving rod (9) is fixed to an end of the support connector b (13) after penetrating through the support connector a (10), another end of the support connector b (13) is hinged to another end of the support connector c (14), the support connector a (10) is provided with an extending portion (16) that inclines upwards and is hinged to the backrest assembly (2), a first connector (17) is hinged to the support connector a (10), the first connector (17) is provided with a sitting posture limiting pin (18) for limiting movement of the first connector (17), the lying posture limiter (12) is configured for limiting movement of a lower end face of the first connector (17), another end of the first connector (17) is hinged to a second connector (19), another end of the second connector (19) is hinged to the base (1), the first connector (17) is hinged to a third connector (20), another end of the third connector (20) is hinged to the backrest assembly (2), a fourth connector (21) is hinged to an inner side of the support connector d (15), a fifth connector (22) is hinged to the second connector (19), a sixth connector (23) is hinged between an end of the fourth connector (21) and an end of the fifth connector (22), and the support connector a (10) is hinged to a middle position of the sixth connector (23).

3. The intelligent sofa mechanical extension device of claim 1, wherein the seat cushion support assembly (3) comprises a support connector a (10), the support connector a (10) is provided with an extending portion (16) that inclines upwards; and the backrest assembly (2) comprises a backrest connector a (24), a backrest connector b (25), a backrest connector c (26) and a backrest connector d (27), an end of a lower portion of the backrest connector a (24) is hinged to an end of the backrest connector b (25), another end of the lower portion of the backrest connector a (24) is hinged to the extending portion (16) of the support connector a (10), an end of a lower portion of the backrest connector c (26) is hinged to another end of the backrest connector b (25), another end of the lower portion of the backrest connector c (26) is hinged to an end of a third connector (20), an upper portion of the backrest connector c (26) is hinged to an end of the backrest connector d (27), and another end of the backrest connector d (27) is hinged to the base (1).

4. The intelligent sofa mechanical extension device of claim 3, wherein a backrest spring (36) is disposed between the backrest connector c (26) and the extending portion (16) of the support connector a (10).

5. The intelligent sofa mechanical extension device of claim 3, wherein a hinge point, at which the upper portion of the backrest connector c (26) and the backrest connector d (27) are hinged, is always located below a middle position of the extending portion (16) of the support connector a (10) during extending or retracting of the extension component.

6. The intelligent sofa mechanical extension device of claim 2, wherein the leg rest plate assembly (4) comprises a leg rest plate connector a (28), a leg rest plate connector b (29) and a leg rest plate connector c (30), an end of the leg rest plate connector a (28) is hinged to an end of the support connector d (15), an end of the leg rest plate connector b (29) is hinged to an end of the support connector a (10), another end of the leg rest plate connector b (29) is hinged to an end of the leg rest plate connector c (30), another end of the leg rest plate connector a (28) and another end of the leg rest plate connector c (30) are respectively hinged to a leg rest plate frame (31), the leg rest plate connector a (28) and the leg rest plate connector c (30) are fixed with each other after being disposed in parallel, the leg rest plate connector a (28) is hinged to the leg rest plate connector b (29), and the leg rest plate connector b (29) is provided with a limiting protrusion (32) for limiting movement of an upper end face of the leg rest plate connector b (29).

7. The intelligent sofa mechanical extension device of claim 2, wherein a first fixing rod (33) is disposed between second connectors (19) on the left side and the right side of the base (1).

8. The intelligent sofa mechanical extension device of claim 3, wherein a second fixing rod (34) is disposed between backrest connectors c (26) on the left side and the right side of the base (1), and a third fixing rod (35) is disposed between backrest connectors d (27) on the left side and the right side of the base (1).

* * * * *